US007328646B2

(12) United States Patent
Jensen et al.

(10) Patent No.: US 7,328,646 B2
(45) Date of Patent: Feb. 12, 2008

(54) HYDRAULIC VALVE ARRANGEMENT

(75) Inventors: Knud Meldgaard Jensen, Augustenborg (DK); Carl Christian Dixen, Sydals (DK)

(73) Assignee: Sauer-Danfoss Aps, Nordborg (DK)

( * ) Notice: Subject to any disclaimer, the term of this patent is extended or adjusted under 35 U.S.C. 154(b) by 302 days.

(21) Appl. No.: 11/127,973

(22) Filed: May 11, 2005

(65) Prior Publication Data

US 2005/0257519 A1 Nov. 24, 2005

(30) Foreign Application Priority Data

May 19, 2004 (DE) ..... 10 2004 025 322

(51) Int. Cl.
*F15B 13/04* (2006.01)

(52) U.S. Cl. ..... 91/447; 91/420

(58) Field of Classification Search ..... 91/420, 91/446, 447; 60/466

See application file for complete search history.

(56) References Cited

U.S. PATENT DOCUMENTS

| | | | | |
|---|---|---|---|---|
| 3,589,387 | A | 6/1971 | Raymond | |
| 4,364,304 | A | 12/1982 | Andersen et al. | 91/420 |
| 4,418,612 | A | 12/1983 | Nanda | |
| 4,569,272 | A | 2/1986 | Taylor et al. | |
| 4,727,792 | A | 3/1988 | Häussler | 91/420 |
| 4,972,761 | A | 11/1990 | Thomsen | |
| 6,865,886 | B2 | 3/2005 | Jensen | 60/466 |
| 2003/0196545 | A1* | 10/2003 | Jensen et al. | 91/447 |

FOREIGN PATENT DOCUMENTS

| | | | |
|---|---|---|---|
| DE | 3800188 | A1 | 7/1989 |
| DE | 19800721 | A1 | 7/1999 |
| DE | 102 16 958 | B3 | 4/2002 |
| DE | 102004025322 | A1 | 12/2005 |
| EP | 0 197 467 | B1 | 1/1992 |
| EP | 0515692 | A1 | 12/1992 |
| EP | 1 045992 | B1 | 11/2004 |

OTHER PUBLICATIONS

European Search Report, Aug. 11, 2005.

* cited by examiner

*Primary Examiner*—Michael Leslie
(74) *Attorney, Agent, or Firm*—McCormick, Paulding & Huber LLP

(57) ABSTRACT

The invention concerns a hydraulic valve arrangement (1) with a control valve module (2) comprising a supply connection arrangement with a high-pressure connection (P) and a low-pressure connection (T) and a working connection arrangement with two working connections (A, B) as well as a control valve (3) between the supply connection arrangement and the working connection arrangement. It is endeavored to improve the control behavior of the valve arrangement. For this purpose. it is ensured that the control valve module (2) has a return compensation valve (15, 16) between the control valve (3) and at least one working connection (A, B).

14 Claims, 1 Drawing Sheet

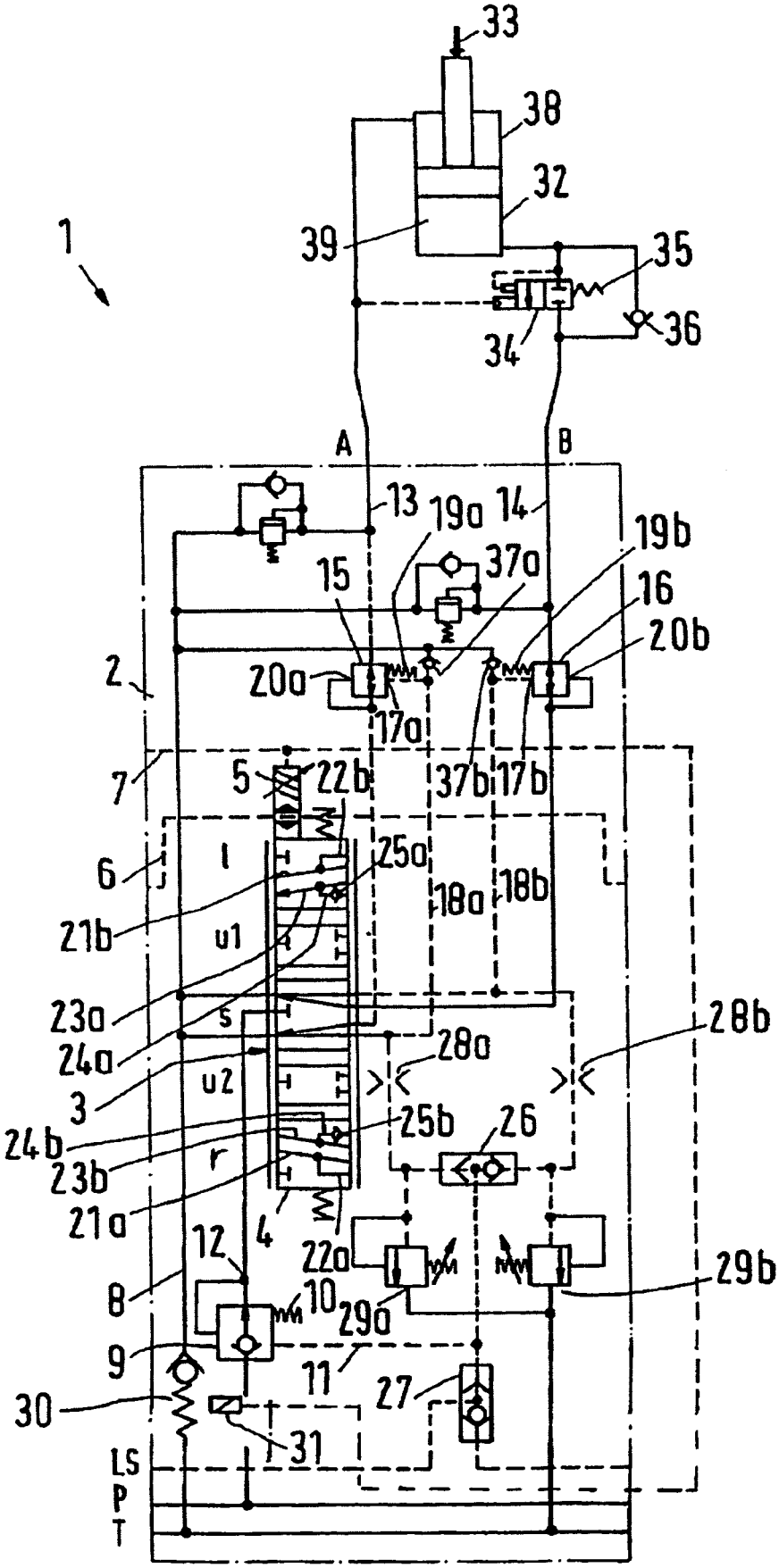
33
38
32
39
1
35
36
34
A
B
13
19a
14
19b
15
37a
16
20b
2
20a
17a
37b
17b
7
5
22b
6
l
25a
18a
18b
21b
u1
23a
s
28b
24a
28a
3
u2
24b
25b
26
23b
r
21a
4
22a
12
29b
8
10
29a
9
11
27
30
31
LS
P
T

HYDRAULIC VALVE ARRANGEMENT

CROSS-REFERENCE TO RELATED APPLICATIONS

Applicant hereby claims foreign priority benefits under U.S.C. §119 from German Patent Application No. 10 2004 025 322.6, filed on May 19, 2004 the contents of which are incorporated by reference herein.

FIELD OF THE INVENTION

The invention concerns a hydraulic valve arrangement with a control valve module comprising a supply connection arrangement with a high-pressure connection and a low-pressure connection and a working connection arrangement with two working connections as well as a control valve between the supply connection arrangement and the working connection arrangement.

BACKGROUND OF THE INVENTION

Such a valve arrangement is known from DE 102 16 958 B3. The valve arrangement serves the purpose of supplying a hydraulic consumer, for example a motor, which is connected with the working connections, with pressurised hydraulic fluid. Return compensation valves are provided at the consumer, which ensures that the consumer is exclusively controlled by the control valve, also when working in the pushing operation.

DE 198 00 721 shows a control device for a hydraulic motor in the form of a hydraulic cylinder. For controlling a lowering movement, the outlet of the consumer is provided with a series connection of a compensation valve and a load retaining valve, which is connected with a working connection. In this connection, the load retaining valve is controlled by a pressure at the other working connection.

When hydraulic consumers exist in the form of motors, be it hydraulic cylinders or rotary motors, a so-called "pushing operation" can in many cases not be avoided. In such a situation, the motor is loaded in the movement direction by an outer force. With a hydraulic cylinder, this may, for example, be a load, which is to be lowered. With a rotary motor driving a vehicle, such a situation may occur, when the vehicle drives down a slope. In all cases, it must be ensured that the movement of the motor occurs exclusively under the control of the control valve. This is the purpose of the return compensation valves.

The design of such load retaining valves appears from, for example, EP 0 197 467 A2.

With a valve arrangement as mentioned in the introduction, it is, however, difficult to adjust the return compensation valves correctly, so that the consumer can be operated in the desired manner.

SUMMARY OF THE INVENTION

The invention is based on the task of improving the control behaviour of the valve arrangement.

With a valve arrangement as mentioned in the introduction, this task is solved in that the control valve module has a return compensation valve between the control valve and at least one working connection.

This means that the return compensation valve is moved from a position at the consumer, that is, at the motor, to a position inside the control valve module. Thus, it is achieved that the control valve can interact substantially more exactly with the return compensation valve, as pressure losses practically no longer occur between the control valve and the return compensation valve. If they should occur to a small extent, they are known and constant. When the return compensation valve is mounted directly at the consumer, these pressure losses can vary heavily from installation to installation. Therefore, an installer needs a certain skill to set the prestressing force of the return compensation valve at a correct value, which ensures that the desired control by the control valve is in fact achieved. When such pressure losses no longer have to be considered, the design is substantially simpler, and an improved control behaviour of the valve arrangement is practically automatically achieved. Further, a cost-effective manufacturing is achieved. The valve arrangement saves space. The risk of a leakage is reduced in relation to an external location of the return compensation valve or a flanged-on location of the return compensation valve.

Preferably, the return compensation valve is directly connected with an outlet of the control valve. Thus, the pressure loss can be kept at the lowest practically achievable value. The consumer is then controlled exclusively via the control valve.

Preferably, the return compensation valve has two control inlets, the first one being connected with a load-sensing pipe and a second one being connected with a point between the control valve and the return compensation valve, the first control inlet being connected with the low-pressure connection via a suction valve. With such a design it is firstly achieved that the return compensation valve closes or throttles more due to the pressure at the second control inlet, when the pressure between the return compensation valve and the control valve increases. In a similar manner, the return compensation valve is acted upon in the opening direction or in the direction of a reduced throttling, when the pressure in the load-sensing pipe increases. This behaviour is known per se in connection with a return compensation valve. The return compensation valve has a valve element, which is controlled by the pressures at the two control inlets. In many cases, this valve element has the form of a slide. The fact that now the load-sensing pipe is connected with the low-pressure connection via a suction valve enables a relatively fast reaction of the return compensation valve to changes in the surrounding pressures. The return compensation valve can namely suck in hydraulic fluid when required. For this purpose, the suction valve preferably has the form of a non-return valve, which opens in the direction of the first control inlet; so that the pressure in the load-sensing pipe cannot immediately flow off to the low-pressure connection, however, sucking in at a too low pressure being possible.

It is also advantageous, when the first control inlet can be connected with the low-pressure connection via a non-return valve located in the slide of the control valve. This ensures a movability of the valve element of the return compensation valve in both directions. A supply with hydraulic fluid from the second control inlet is uncritical, as here a sufficient supply of fluid is always available. At the first control inlet, however, the connection to the low-pressure connection makes it possible for the return compensation valve to feed hydraulic fluid through the suction valve or to discharge fluid through the non-return valve, which can be connected with the low-pressure connection. Anyway, a discharge of hydraulic fluid via the first control inlet is only required, when the slide is in a corresponding position.

Preferably, the non-return valve ends in a path in the slide, which can be connected with the low-pressure connection.

With regard to the design, this is a relatively simple solution, which keeps the manufacturing costs of the control valve low.

Preferably, seen from the control valve a load retaining valve is located at the other side of the return compensation valve, which load retaining valve can be opened by means of a pressure at the other working connection. The return compensation valve can throttle the flow of hydraulic fluid flowing from one working connection to the control valve. However, it is usually not immediately able to interrupt this fluid flow. When, now, a load retaining valve is located between the consumer and the working connection, the consumer is secured, that is, it can actually be "locked" in an assumed position, also when an outer load is acting upon the consumer.

Preferably, the first control inlet, at least of the return control valve, which is connected in series with the load retaining valve, is connected with the low-pressure connection via a counter-pressure valve. This makes it possible, during trouble-free operation, always to maintain a pressure in the load-sensing pipe, which is required to open the load retaining valve. Finally, the pressure generated by the counter-pressure valve must only be so high that it makes it possible to keep the load retaining valve open.

Preferably, the counter-pressure valve is electrically activated, the control vale is electrically activated, and the counter-pressure valve and the control valve react to the same electrical signal. Instead of an electrical actuation, also a hydraulical, a mechanical or another auxiliary force effected actuation can be used. Thus, the deflection of the control valve can at the same time activate the counter-pressure valve, so that it is ensured that the load-retaining valve opens, as soon as this is required. Without a corresponding actuation of the control valve, however, this is not required, so that the counter-pressure valve can remain inactivated.

It is also advantageous, when the counter-pressure valve is located in the control valve module. Thus, when using several control valve modules, each control valve and each connected consumer has its own counter-pressure valve. This permits individual control of each consumer.

Preferably, a return compensation valve is allocated to each working connection. Thus, the consumer can be loaded in both directions. Then, the consumer is still controlled exclusively by the control valve in both directions.

It is preferred that each first control inlet is connected with a pressure control valve via a throttle, the pressure control valves being adjustable to different pressures. This ensures in a simple manner that the consumer can be operated in different directions in different manners.

It is preferred that an outlet is connected between the throttle and the pressure control valve of each return compensation valve with a shuttle valve, whose outlet is connected with an inlet of an inlet compensation valve connected in series with the control valve. The inlet compensation valve can then form a proportional valve together with the control valve. The inlet compensation valve ensures that a constant pressure is always available over the control valve, so that the fluid amount controlled by the control valve depends exclusively on the opening cross-section, which is released by the control valve. The pressure at the inlet compensation valve is then controlled by the higher of the pressures in the load-sensing pipes.

Preferably, the control valve has a slide, which is displaceable into two working positions and one neutral position, a blocking position being provided between the neutral position and each working position. The two working positions serve the purpose of driving the consumer in one direction or the other. In the neutral position both outlets of the control valve are connected to the tank, so that no "wrong" signals can occur, which might open the load retaining valve. To provide a defined transition between the neutral position and the drive in one direction or the other, a blocking is provided between the neutral position and the two working positions, in which the path from the supply connection arrangement to the working connection arrangement is in fact interrupted.

BRIEF DESCRIPTION OF THE DRAWINGS

In the following, the invention is described by means of a preferred embodiment in connection with the drawing, showing:

Only FIGURE is a schematic view of a hydraulic valve arrangement.

DETAILED DESCRIPTION OF THE PREFERRED EMBODIMENTS

A hydraulic valve arrangement 1 has a control valve module 2 comprising a high-pressure connection P and a low-pressure connection T. Together, the high-pressure connection P and the low-pressure connection T form a supply connection arrangement. Further, the control valve module 2 comprises two working connections A, B, together forming a working connection arrangement. Finally, there is a load-sensing connection LS, which reports the higher existing load pressure, so that the supply pressure is adapted to the load pressure. The control valve module 2 is here shown as a box. It is realised in a combined housing.

Between the supply connection arrangement P, T and the working connection arrangement A, B is located a control valve 3 in the form of a slide valve. The control valve 3 has a slide 4, which can be displaced to different positions by a drive 5. On the one side, the drive 5 can be hydraulically controlled by a pilot pipe 6. On the other side, also an electrical control via a control line 7 is possible.

In the position shown, the slide 4 is in a so-called neutral positions, in which the two working connections A, B are connected with a tank pipe 8, which leads to the low-pressure connection T. Due to valves, which will be described in the following, a consumer connected with the working connections A, B is blocked in the neutral position.

The slide 4 can be moved to a first working position I and a second working position r. In the working position r, the working connection A is connected with the high-pressure connection P. In the working position I, the working connection B is connected with the high-pressure connection P.

Between the floating position s and each of the two working positions I, r of the slide 4 is provided a blocking position u1, u2, in which a connection between the working connections A, B and the high-pressure connection P is interrupted.

As usual with slide valves, the two working positions I, r are not to be understood as discrete positions. In each working position I, r, the slide 4 can be further displaced to release differently large flow cross-sections for the hydraulic fluid from the high-pressure connection P to one of the two working connections A, B and from the other of the two working connections B, A to the tank connection T (meter-out).

An inlet compensation valve 9 is located between the high-pressure connection P and the control valve 3. In the opening direction, the inlet compensation valve 9 is acted upon by the force of a spring 10 and the pressure in a control pipe 11 and in the closing direction by a pressure at a point 12 between the inlet compensation valve 9 and the control valve 3. As will be explained below, the inlet compensation valve 9 ensures that the pressure over the control valve 3 remains constant, so that the fluid amount flowing from the high-pressure connection P to one of the two working connections A, B is exclusively determined by the size of the flow cross-section released by the slide 4. Thus, the inlet compensation valve 9 and the control valve 3 form a load-independent valve, which could also be called a proportional valve.

The working connection A is connected with the control valve via a working pipe 13 and the working connection B is connected with the control valve via a working pipe 14. A return compensation valve 15 is located in the working pipe 13. A return compensation valve 16 is located in the working pipe 14. In principle, both return compensation valves 15, 16 have the same design. Therefore, they will be explained in common. Both return compensation valves 15, 16 are located inside the control valve module 2 and relatively close to the control valve 3. In other words, the two return compensation valves 15, 16 immediately follow the control valve 3, so that no or merely an extremely small pressure loss occurs between the return compensation valves 15, 16 and the control valve.

Each return compensation valve 15, 16 has a first control inlet 17*a*, 17*b*. The letter a is used for the reference number allocated to the return compensation valve 15. The letter b is used for the reference number allocated to the return compensation valve 16. The control inlet 17*a*, 17*b* is connected with a load-sensing pipe 18*a*, 18*b*. During a corresponding deflection of the slide 4, which effects a connection to the pressure connection P, the load-sensing pipe 18*a*, 18*b* is supplied with the same pressure as the section of the working pipe 13, 14 between the return compensation valve 15, 16 and the control valve 3.

The force of a spring 19*a*, 19*b* acts in the same direction as the pressure at the first control inlet 17*a*, 17*b*. The pressure at the first control inlet 17*a*, 17*b* and the force of the spring 19*a*, 19*b* act in a direction, in which the return compensation valves 15, 16 open, that is, enlarge their flow cross-section.

In the opposite direction acts a pressure at a second control inlet 20*a*, 20*b*, which is connected with a section of the working pipe 13, 14 between the return compensation valve 15, 16 and the control valve 3.

In each working position I, r of the slide 4; the control valve 3 creates a supply path 21*a*, 21*b*, which forms a connection between the outlet of the inlet compensation valve 9 and the corresponding working pipe 13, 14. A control path 22*a*, 22*b* branches off from the supply path 21*a*, 21*b*, said supply path ending in the corresponding load-sensing pipe 18*a*, 18*b*.

Further, in dependence of its position the slide 4 creates a return path 23*a*, 23*b* for each working position I, r, through which path the working pipe 13, 14, which is not connected with the inlet compensation valve 9 is connected with the tank pipe 8. In the return path 23*a*, 23*b* a relief path, 24*a*, 24*b* ends, in which a non-return valve 25*a*, 25*b* is located, which opens in the direction of the tank pipe 8. In the corresponding position of the slide 4, the relief path 24*a*, 24*b* is connected with the load-sensing pipe 18*a*, 18*b*.

The two load-sensing pipes 18*a*, 18*b* are connected with each other via a shuttle valve 16, whose outlet is connected with a further shuttle valve 27, which passes on the higher pressure ruling in a hydraulic system, in which also the valve arrangement 1 is located, to a load-sensing connection LS.

Between the shuttle valve 26 and the control valve 3, a throttle 28*a*, 28*b* is provided for each load-sensing pipe 18*a*, 18*b*. Between the throttle 28*a*, 28*b* and the shuttle valve 26, a pipe with a pressure control valve 29*a*, 29*b* branches off. The two pressure control valves 29*a*, 29*b* are connected with a merely schematically shown counter-pressure valve 30, which can, in the embodiment shown, be activated by an electrical drive 31. However, in another embodiment, it can also be self-acting. The drive 31 is connected with the control pipe 7, so that the control valve 3 and the counter-pressure valve 30 can be activated at the same time by means of the same control signal. The counter-pressure valve 30 is connected with the low-pressure connection T. It ensures that a predetermined minimum pressure exists in the load-sensing pipe 18*a*, 18*b* in question.

A hydraulic consumer in the form of a hydraulic cylinder 32 is connected to the two working connections A, B. An outer force represented by the arrow 33 acts upon the cylinder. In the pipe leading to the working connection B is located a load-retaining valve 34, which is acted upon in the opening direction by the pressure at the working connection A and the pressure at its own outlet and in the closing direction by the force of a spring 35. In parallel with the load-retaining valve 34 is located a non-return valve 36 opening in the direction of the cylinder 32.

The load-retaining valve 34 is able to close the pipe between the cylinder 32 and the control valve module 2 completely. The return compensation valves 15, 16 are not necessarily able to completely interrupt the working pipes 13, 14.

Each of the two load-sensing pipes 18*a*, 18*b* is connected with the tank pipe via an anti-cavitation valve 37*a*, 37*b*. The anti-cavitation valves 37*a*, 37*b* are non-return valves opening in the direction of the first control inlet 17*a*, 17*b*.

The valve arrangement works as follows:

When the slide 4 of the control valve 3 is displaced to the working position r, the working pipe 13 is supplied with pressure from the high-pressure connection P. At the same time, the load-sensing pipe 18*a* is supplied with pressure. As, now, the same pressure rules at the two control inlets 17*a*, 20*a* of the return compensation valve 15, this valve is opened via the spring 19*a*. Now, the upper working chamber 38 of the cylinder 32 is exposed to pressure. This displaces hydraulic fluid from the lower working chamber 39. This is possible, as the pressure at the working connection A has opened the load-retaining valve 34. Both the load-sensing pipe 18*b* and the section of the working pipe 14 between the return compensation valve 16 and the control valve 3 are practically without pressure, so that the return compensation valve 16 opens under the effect of the spring 19*b*. The hydraulic fluid displaced from the working chamber 39 can thus flow off to the low-pressure connection T through the control valve 3. At the throttles available in the control valve, but not shown in detail, a pressure builds up, which leads to a corresponding pressure increase in the section of the working pipe 14 between the return compensation valve 16 and the control valve 3, which further throttles the return compensation valve 16 so that a balance occurs between the force of the spring 19*b* and the pressure at the second control inlet 20*b* of the return compensation valve 16. The return compensation valve 16 thus throttles the return from the second working chamber 39 of the hydraulic cylinder 32 so that the control occurs practically exclusively via the control valve 3.

In the opposite direction the hydraulic cylinder 32 is activated in that the control valve 3 is displaced to the working position I. In this case, hydraulic fluid can reach the cylinder 32 through the non-return valve 36 by avoiding the load-retaining valve 34. In the "return path" the return compensation valve 15 then throttles the fluid displaced from the first working chamber 38 so that the actuation of the cylinder 32 is controlled exclusively by the control valve 3, also when a force would be applied on the cylinder 32 against the direction of the arrow 33.

In each case, the pressure control valves 29*a*, 29*b* ensure that the pressure in the load-sensing pipes 18*a*, 18*b* do not exceed a predetermined value. If this should be the case, hydraulic fluid is discharged to the low-pressure connection T via the counter-pressure valve 30. At any rate, the counter-pressure valve 30 ensures that a sufficient pressure is available for actuating the load-retaining valve 34.

The respective higher pressure from the two load-sensing pipes 18*a*, 18*b* is passed on to the inlet compensation valve 9 via the control pipe 11, the inlet compensation valve 9 opening accordingly as much as the pressure available in the load-sensing pipes 18*a*, 18*b* requires.

In the present embodiment, the load-retaining valve 34 is relieved to the environment, which takes place by means of the counter-pressure valve. In other embodiments, however, it is also possible to relieve this load-retaining valve to the working pipe 14, to close the load-retaining valve hermetically or to relieve to a connected proportional valve or to the tank.

Instead of the pressure control shown, the slide of the control valve 3 can also cause a flow control or a mixed pressure and flow control.

Locating the two return compensation valves 15, 16 in the immediate vicinity of the control valve 3 inside the control valve module 2 has the advantage that the risk of a leakage is substantially reduced in comparison with an external unit or a flanged-on unit, which comprises the return compensation valves 15, 16. With a larger distance from the control valve, the piping can always cause a pressure loss, which has to be corrected via the springs 19*a*, 19*b*. Usually, however, the size of the loss is not known. When, on the other hand, the return compensation valves 15, 16 are located close to the control valve 3 as shown in the present embodiment, a pressure loss does practically not occur, so that a complete control of the tolerances and a continuously steady performance is achieved.

The anti-cavitation valves 37*a*, 37*b* and the non-return valves 25*a*, 25*b* make it possible for the slide (or another valve element) in the return compensation valves 15, 16 to react extremely fast. The slide can namely supply or displace oil without having to overcome serious resistances.

While the present invention has been illustrated and described with respect to a particular embodiment thereof, it should be appreciated by those of ordinary skill in the art that various modifications to this invention may be made without departing from the spirit and scope of the present invention.

The invention claimed is:

1. A hydraulic valve arrangement with a control valve module, the control valve module comprising:

a supply connection arrangement with a high-pressure connection and a low-pressure connection;

a working connection arrangement with two working connections;

a control valve between the supply connection arrangement and the working connection arrangement; and a return compensation valve between the control valve and at least one working connection.

2. The valve arrangement according to claim 1, wherein the return compensation valve is directly connected with an outlet of the control valve.

3. The valve arrangement according to claim 1, wherein the return compensation valve has two control inlets, a first one being connected with a load-sensing pipe and a second one being connected with a point between the control valve and the return compensation valve, the first control inlet being connected with the low-pressure connection via a suction valve.

4. The valve arrangement according to claim 1, wherein seen from the control valve a load retaining valve is located at the other side of the return compensation valve, which load retaining valve can be opened by means of a pressure at the other working connection.

5. The valve arrangement according to claim 1, wherein a return compensation valve is allocated to each working connection.

6. The valve arrangement according to claim 5, wherein each first control inlet is connected with a pressure control valve via a throttle, the pressure control valves being adjustable to different pressures.

7. The valve arrangement according to claim 6, wherein an outlet is connected between the throttle and the pressure control valve of each return compensation valve with a shuttle valve, whose outlet is connected with an inlet of an inlet compensation valve connected in series with the control valve.

8. The valve arrangement of claim 1, wherein the control valve module is in a combined housing.

9. A hydraulic valve arrangement with a control valve module comprising a supply connection arrangement with a high-pressure connection and a low-pressure connection and a working connection arrangement with two working connections as well as a control valve between the supply connection arrangement and the working connection arrangement, wherein a return compensation valve is between the control valve and at least one working connection;

wherein the return compensation valve has two control inlets, a first one being connected with a load-sensing pipe and a second one being connected with a point between the control valve and the return compensation valve, the first control inlet being connected with the low-pressure connection via a suction valve; and wherein the first control inlet can be connected with the low-pressure connection via a non-return valve located in a slide of the control valve.

10. The valve arrangement according to claim 9, wherein the non-return valve ends in a path in the slide, which can be connected with the low-pressure connection.

11. A hydraulic valve arrangement with a control valve module comprising a supply connection arrangement with a high-pressure connection and a low-pressure connection and a working connection arrangement with two working connections as well as a control valve between the supply connection arrangement and the working connection arrangement, wherein a return compensation valve is between the control valve and at least one working connection; and wherein a first control inlet of the return compensation valve is connected with the low-pressure connection via a counter-pressure valve.

12. The valve arrangement according to claim 11, wherein the counter-pressure valve is electrically activated, the control valve is electrically activated, and the counter-pressure valve and the control valve react to the same electrical signal.

13. The valve arrangement according to claim 11, wherein the counter-pressure valve is located in the control valve module.

14. A hydraulic valve arrangement with a control valve module comprising a supply connection arrangement with a high-pressure connection and a low-pressure connection and a working connection arrangement with two working connections as well as a control valve between the supply connection arrangement and the working connection arrangement, wherein a return compensation valve is between the control valve and at least one working connection; and wherein the control valve has a slide, which is displaceable into two working positions and one floating position, a blocking position being provided between the floating position and each working position.

* * * * *